United States Patent [19]

Ishizuka

[11] 4,411,672

[45] Oct. 25, 1983

[54] METHOD FOR PRODUCING COMPOSITE OF DIAMOND AND CEMENTED TUNGSTEN CARBIDE

[76] Inventor: Hiroshi Ishizuka, 19-2, Ebara 6-chome, Shinagawa-ku, Tokyo, Japan

[21] Appl. No.: 285,619

[22] Filed: Jul. 21, 1981

[30] Foreign Application Priority Data

Aug. 14, 1980 [JP] Japan ..... 55-112317

[51] Int. Cl.[3] ..... B24D 3/02

[52] U.S. Cl. ..... 51/309; 51/307

[58] Field of Search ..... 51/307, 309

[56] References Cited

U.S. PATENT DOCUMENTS

| | | | |
|---|---|---|---|
| 3,745,623 | 7/1973 | Wentrof et al. | 76/101 A |
| 4,063,909 | 12/1977 | Mitchell | 51/309 |
| 4,215,999 | 8/1980 | Phaal | 51/309 |
| 4,219,339 | 8/1980 | Wilson | 51/309 |
| 4,225,322 | 9/1980 | Knemeyer | 51/309 |
| 4,268,276 | 5/1981 | Bovenkerk | 51/309 |

*Primary Examiner*—Donald E. Czaja
*Assistant Examiner*—W. Thompson
*Attorney, Agent, or Firm*—Larson and Taylor

[57] ABSTRACT

A composite of diamond and cemented tungsten carbide is produced by placing pulverized diamond in adjacency with a tungsten carbide/cobalt composition. The two materials are separated by a metallic material positioned therebetween which material has a melting point, when so utilized, lower than the eutectic point of the tungsten carbide/cobalt composition. The assembly is heated at a temperature high enough to permit melting of the metallic material and in a pressure-temperature region of the carbon phase diagram where diamond is thermodynamically stable but which temperature is insufficient to cause substantial melting of the tungsten carbide/cobalt composition. In this way, a controlled amount of metal is introduced into the pulverized diamond to promote bonding thereof.

10 Claims, No Drawings

METHOD FOR PRODUCING COMPOSITE OF DIAMOND AND CEMENTED TUNGSTEN CARBIDE

The present invention relates to a method for producing a composite of diamond and cemented tungsten carbide, particularly to such material suitable for forming an abrasive element, a wire drawing die or other tools to be used in a severely abrasive environment.

Powder of such super hard material as diamond has been being treated under an elevated pressure-temperature condition together with cemented tungsten carbide as a support material for producing a unitarily formed composite materials for application to an abrasive tool tip, a wire drawing die or other wear resistant elements. In practice, a metallic material is employed as a medium for binding adjacent diamond particles and for securing the diamond mass to the support of cemented tungsten carbide, the metallic material consisting for the most part of cobalt which comes from the tungsten carbide-cobalt composition. Alternatively, the metallic material may come from a tantalum foil placed between the two adjacent bodies. Such techniques are known from, for example, U.S. Pat. No. 3,745,623 to Wentorf Jr. et al and U.S. Pat. No. 4,063,909 to Mitchell.

Since the hardness of the resulting composite product decreases with an increasing amount metallic phase to present among the diamond particles, a good wear resistance is only obtained by having such metallic present in a very limied amount so as to provide the highest possible hardness and the strongest possible bond between the particles. Conventional products of this kind, however, do not necessarily show a properly high hardness. To take an example, U.S. pat. No. 3,745,623 describes a unitarily formed composite (for a tool insert) of diamond secured to a supportof cemented tungsten carbide. The product is obtained from a process in which pulverized diamond is essentially placed in an immediate adjacency to a block of tungsten carbide and cobalt. In this case the liquid phase of metal which serves as a binder between neighboring diamond particles and between the diamond and tungsten carbide-cobalt bodies mainly comprises cobalt from the carbide-cobalt composition. This cobalt is thus supplied in an unregulatable abundance to the diamond mass, only to leave rather an excessive amount of metallic phase among the diamond particles of resulting composite, which inevitably exhibits rather a decreased hardness. In addition, the temperature requirement on the order of as high as 1500°-1600° C. for sintering the cobalt-carbide composition necessitates application of a pressure correspondingly high in order to place the combined pressure-temperature condition in the thermodynamical diamond stability region of carbon phase diagram.

On the other hand, U.S. Pat. No. 4,063,909 describes a process by which pulverized diamond, as mixed with particles of binding metal such as cobalt, is treated together with a soldering material, such as tantalum metal, and a support of cemented tungsten carbide. Resulting agglomerates exhibit a structure in which diamond particles have been joined together with the intervening cobalt phase, and the diamond and tungsten carbide bodies have been joined to one another with a strong bond of tantalum carbide to each of the diamond and tungsten carbide. In this case, similarly to the above, the process involves a temperature requirement well above the eutectic point of the cobalt-carbon (as diamond) system and therefore, a pressure correspondingly high so that the treatment is effected in the diamond stability region.

Thus a principal object of the present invention is to provide an effective method, which avoids the above drawbacks, for production of composite material of diamond and cemented tungsten carbide which exhibits a substantially improved bond and hardness of diamond body. According to the invention there is provided a method for producing a composite of diamond and cemented tungsten carbide, which method comprises:

placing pulverized diamond adjacently to a composition of tungsten carbide and cobalt, said diamond and composition being separated from each other by a second metallic material, said second metallic material having a melting point in an employed circumstance below the eutectic point of said composition of tungsten carbide and cobalt;

heating said assembly to a temperature sufficiently high to cause the second metal to melt but not high enough to effect co-melting of the tungsten carbide and cobalt;

maintaining said assembly at said temperature in a pressure-temperature region of the carbon phase diagram where diamond is thermo-dynamically stable, to join diamond particles to each other as well as the diamond and composition of tungsten carbide and cobalt; and recovering a composite of diamond and cemented tungsten carbide.

In the invention, several kinds of metal are effectively usable which essentially exhibit a eutectic point with the system cobalt-carbon lower than tungsten does with this system. Among such metals cobalt- or nickel-based alloys are favorable, and alloys of Invar (Fe-36 Ni) and Kovar (Fe- 29 Ni-17 Co) compositions are a few of important examples (proportions being indicated in weight percentage as usual).

An addition of material to form a stable carbide, such as chromium, titanium and tantalum, at least in a minor amount to the second metallic material is effective for reducing the tendency of cracking and/or disintegration of the unitary composite product. The additive metals may be used in various ways: they can be introduced as alloyed with cobalt or nickel as the second metal, they can be plated on such metal, or they can be charged in a form of coarse or fine powder or foil. The prerequisite to the additive is that it should melt in the employed circumstance at a temperature far below the eutectic point of tungsten carbide-cobalt system, and be catalytic, as fused, for conversion of graphite to diamond.

Employment of the metals of the above kind, with or without the additive, when placed between the diamond mass and composition of tungsten carbide and cobalt, permits a sintering process of such assembly to be completed in a temperature range low enough to prevent any substantial influx of alloyed cobalt melt from the composition so that the diamond particles are bonded to each other with a predetermined amount of metal, and as a whole, to the composition to form a support.

The combined pressure-temperature condition for this method should essentially be comprised in a thermodynamic diamond stability region of the carbon phase diagram such as determined by R. Berman and Sir F. Simon in Zeitschrift für Elektrochemie, Vol. 59, No. 5 (1955) pp. 333-338, and by C. Scott Kennedy and George C. Kennedy in Journal of Geophysical Research, Vol. 81, No. 14 (1976) pp. 2467–69.

EXAMPLE 1

A hollow cylinder of 10 mm in inner diameter and 12 mm in length, made of NaCl, is loaded with a 1.5 mm thick hard sintered WC-8% Co (by weight) disk, a 0.1 mm thick cobalt disk, a 0.05 mm thick tantalum foil and a 0.6 mm thick layer of 200/300 mesh (Tyler) diamond powder, each 10 mm across, in this sequence from the center towards either end of the cylinder. The thus filled cylinder is closed at each opening end with a NaCl plug, and mounted on an ultrahigh pressure apparatus as described in U.S. Pat. No. 3,988,087 for treatment under a pressure of approximately 55 Kb simultaneously at a temperature of approximately 1350° C. for five minutes. Both of two composite products recovered from the reaction mass show a hardness (Knoop) within a range of 6,000 to 8,000.

Reference

A cylinder assembly, as in the above run but without the cobalt and tantalum disks, is subjected to a combined pressure-temperature condition, approximately of 60 Kb and 1500° C., for five minutes. The resulting composites exhibit a Knoop hardness in a range of 4,000 to 5,000.

EXAMPLE 2

The operation in Example 1 is repeated with an inverted placement of the cobalt and tantalum disks. The hardness achievement is substantially the same as in the Example 1.

EXAMPLE 3

A hollow cylinder of the same material and dimensions as in Example 1 is loaded with a soft sintered mixture of WC-8% Co of 2 mm in thckness, a 0.2 mm thick disk of Kovar alloy, and a 0.6 mm thick layer of 100/200 mesh (Tyler) diamond powder, each 10 mm across, in this sequence from the center towards either end of the cylinder, which as charged thus is closed with a NaCl plug and subjected to a pressure of approximately 57 Kb and simultaneously at a temperature of approximately 1400° C. for three minutes. Both of two composite products recovered exhibit a Knoop hardness level of 5,800.

EXAMPLE 4

The run in Example 3 is repeated with an addition of approximately 1% chromium particles, by weight relative to the alloy, as spreaded between the latter and diamond. The resulting composites show a hardness of a substantially same level as in Example 3 and no cracks or disintegrations.

EXAMPLE 5

A run as in Example 3 is repeated substituting diamond particles of a much finer size of 12~25 μm and an Invar alloy for corresponding materials. The achievements performed are substantially the same as in Example 3.

EXAMPLE 6

An operation is conducted which is similar to that in Example 5 except that a titanium foil is added in an amount of 1% by weight relative to the alloy material, as placed between the latter and diamond. Resulting composite products show an excellent hardness as in Example 5 and are free of cracks and disintegration.

As set forth above in detail, the invention permits the supply of a liquid medium for binding diamond particles with each other as well as the diamond and tungsten carbide bodies, from a source which is independent of the tungsten carbide-cobalt composition, and to provide such liquid phase below a temperature where the tungsten carbide/cobalt composition begins to melt in the employed circumstances. Thus the invention provides composite products of diamond and cemented tungsten carbide of a substantially improved hardness or, in other words, wear resistance, by preventing any metallic influx from the composition portion to effectively regulate the metallic volume intervening between adjacent diamond particles and between the diamond mass and composition of tungsten carbide and cobalt.

What I claim is:

1. A method for producing a composite of diamond and cemented tungsten carbide, which method comprises:

placing a layer consisting of pulverized diamond adjacent to a sintered tungsten carbide-cobalt support, said pulverized diamond and support being separated from each other by a second metallic material, said second metallic material having a melting point, when so utilized, below the eutectic point of said sintered tungsten carbide-cobalt support;

heating said assembly to a temperature sufficiently high to cause the second metal to melt but not high enough to effect co-melting of the tungsten carbide and cobalt, said heating being effected in a pressure-temperature region of the carbon phase diagram where diamond is thermodynamically stable, and maintaining said temperature in said temperature-pressure region to join the diamond particles to each other and to join the diamond particles to said sintered tungsten carbide-cobalt support; and recovering a composite of diamond and cemented tungsten carbide.

2. A method as recited in claim 1, in which said second metallic material comprises a cobalt-based alloy.

3. A method as recited in claim 1, in which said second metallic material comprises a nickel-based alloy.

4. A method as recited in claim 1, in which said second metallic material consists essentially of cobalt, nickel and iron.

5. A method as recited in claim 3, in which said second metallic material consists essentially of nickel and iron.

6. A method as recited in claim 3, in which said second metallic material consists essentially of cobalt and iron.

7. A method as recited in claim 1, in which said heating is effected in the presence of a metallic additive capable of forming a stable carbide.

8. A method as recited in claim 7, in which said metallic additive is selected from the group consisting of chromium, titanium and tantalum.

9. A method as recited in claim 1, in which said composition of tungsten carbide and cobalt is hard sintered prior to placement in adjacency with the pulverized diamond.

10. A method as recited in claim 1, in which said composition of tungsten carbide and cobalt is soft sintered prior to placement in adjacency with the pulverized diamond.

* * * * *